United States Patent [19]

Seragnoli

[11] Patent Number: 4,463,767

[45] Date of Patent: Aug. 7, 1984

[54] CONTINUOUS TWIN ROD CIGARETTE-MAKING MACHINE

[75] Inventor: Enzo Seragnoli, Bologna, Italy

[73] Assignee: G. D. Societa per Azioni, Bologna, Italy

[21] Appl. No.: 357,184

[22] Filed: Mar. 11, 1982

[30] Foreign Application Priority Data

Apr. 1, 1981 [IT] Italy ..... 48179 A/81

[51] Int. Cl.[3] ..... A24C 5/14; A24C 5/18; A24C 5/34; A24C 5/39

[52] U.S. Cl. ..... 131/84 B; 131/84 C; 131/109 R; 131/110; 131/904; 131/906

[58] Field of Search ..... 131/109 R, 109 B, 904, 131/84 R, 906, 110, 109 AB, 84 C, 84 B

[56] References Cited

U.S. PATENT DOCUMENTS

| | | | |
|---|---|---|---|
| 3,311,114 | 3/1967 | Schlossmacher | 131/109 R |
| 4,063,563 | 12/1977 | Lorenzen | 131/906 |
| 4,185,644 | 1/1980 | Heitmann et al. | 131/109 R |
| 4,330,001 | 5/1982 | Hodsall | 131/109 B |
| 4,336,812 | 6/1982 | Seragnoli | 131/84 C |
| 4,372,326 | 2/1983 | Seragnoli | 131/84 B |
| 4,373,538 | 2/1983 | Steiniger | 131/109 R |

*Primary Examiner*—V. Millin
*Assistant Examiner*—Harry J. Macey
*Attorney, Agent, or Firm*—Marshall, O'Toole, Gerstein, Murray & Bicknell

[57] ABSTRACT

A continuous twin rod cigarette making machine operable to permit the simultaneous formation of two continuous rods of cigarette starting from two layers of tobacco supported by suction beneath respective suction conveyors located above respective ascending shafts, the flow of tobacco along the ascending shafts being adjusted in dependence on signals emitted by sensors of the density or weight of the layers by adjustment elements including two channels coupled to respective vibrators, the frequency of which is adjustable, and communicating on one side with respective descending shafts extending from a carding unit to the ascending shafts, and on the other with a recycled tobacco particle supply device.

10 Claims, 6 Drawing Figures

Fig.2
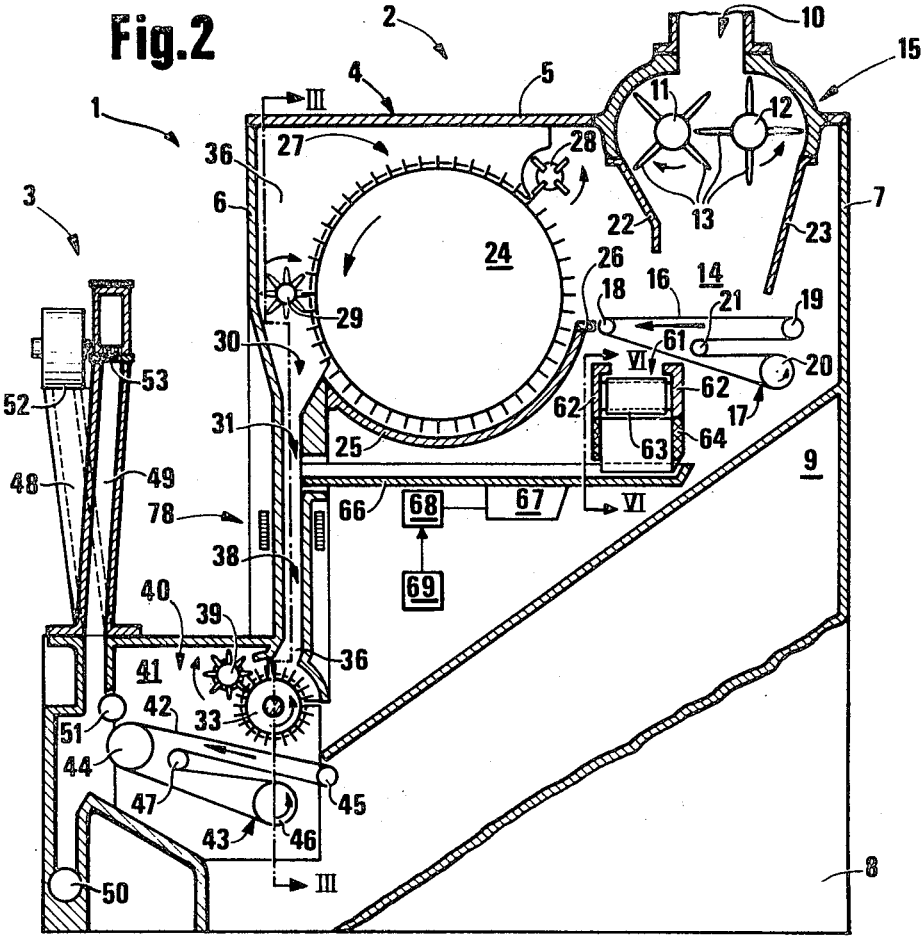
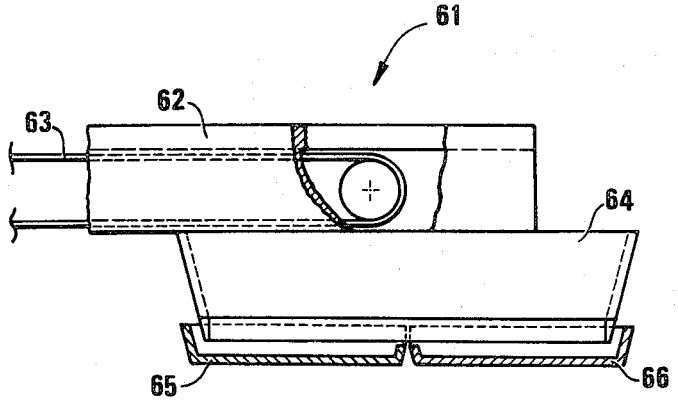
Fig.6

CONTINUOUS TWIN ROD CIGARETTE-MAKING MACHINE

BACKGROUND OF THE INVENTION

The present invention relates to a continuous twin rod cigarette making machine.

In particular, the present invention relates to a cigarette making machine of the type specified above and comprising a carding unit and an advancement unit positioned at the upper end and, respectively, the lower end of a descending shaft for the tobacco particles, and two ascending shafts positioned partially alongside one another downstream of the said advancement unit in the sense of movement of the said particles and upstream of respective suction conveyors for the formation of respective continuous layers of tobacco.

SUMMARY OF THE INVENTION

The subject of the present invention is an improvement of the above described known cigarette-making machine, the purpose of which is that of permitting an accurate control of the said two layers of tobacco to be obtained in a simple and economic manner, this being applied during the formation stage of these in such a way as to ensure that they are substantially equalised.

According to the present invention there is provided a continuous twin rod cigarette-making machine for the simultaneous formation of two continuous rods of cigarette, comprising a carding unit and an advancement unit positioned at the upper and lower ends respectively of a descending shaft for tobacco particles, and two ascending shafts disposed partially alongside one another downstream of the said advancement unit in the direction of movement of the said particles and upstream of respective suction conveyors for the formation of respective continuous layers of tobacco, characterised by the fact that it includes an inner wall subdividing the said descending shaft into two substantially equal descending shafts; the said advancement unit including two advancement rollers disposed beneath respective said descending shafts and driven by respective actuation means independent from one another and dependent on detector means disposed along the paths of the said layers; and adjustment means, dependent on respective control means, being provided for adjusting the quantity of tobacco supplied to the said descending shafts.

BRIEF DESCRIPTION OF THE DRAWINGS

Further characteristics and advantages of the present invention will become apparent from the following description with reference to the attached drawings which illustrate a non-limitative embodiment thereof, in which:

FIG. 2 is a section taken on the line II—II of FIG. 1;

FIG. 6 is a section taken on the line VI—VI of FIG. 2.

DETAILED DESCRIPTION OF THE INVENTION

Figure 1:
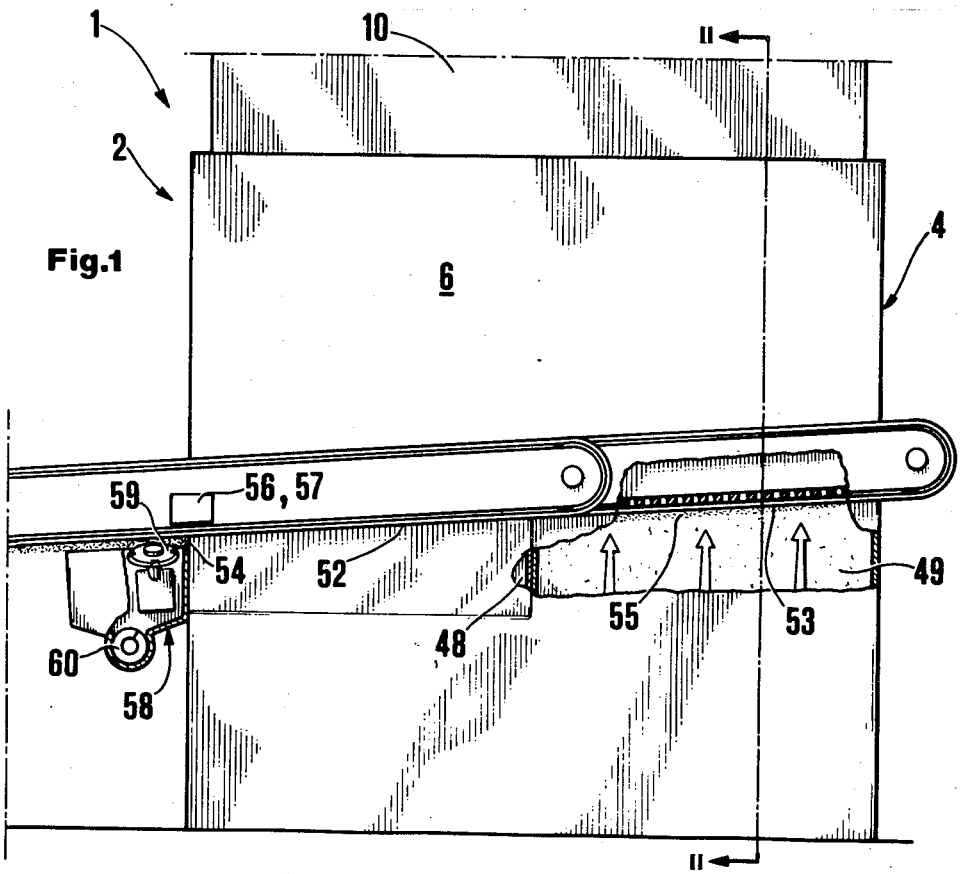
FIG. 1 is a schematic front view with parts in section and parts removed for clarity of a cigarette-making machine formed according to the principles of the present invention.

FIGS. 1 and 2 illustrate in detail a cigarette-making machine 1, comprising a distributor 2 which consists of a device for receiving a mass of shredded tobacco and for working it in such a way as to form two continuous and uniform flows of tobacco particles. The machine 1 further includes a section 3 (on the left as viewed in FIG. 1) which is supplied from the distributor 2 and is operable to form two continuous rods of cigarette starting from the said two continuous flows of tobacco particles.

The component members of the distributor 2 are contained in a vertically extending casing 4, which is closed at the top by a horizontal wall 5 and at the sides by two vertical walls 6, 7. On the two sides parallel to the plane of FIG. 2, the casing 4 is closed by a front wall 8 and a rear or bottom wall 9.

The previously mentioned mass of shredded tobacco is supplied to the distributor 2 via an input shaft 10 extending through the wall 5 and terminating above two rollers 11,12. The latter are rotatable in opposite senses within the casing 4, and are provided around their periphery with radial teeth 13 for subjecting the shredded tobacco to a preliminary carding operation and for conveying it into an underlying chamber 14.

The shaft 10 and the rollers 11,12 together define a pre-supply unit 15 positioned over the chamber 14, the bottom of which is defined by a conveyor band 16 constituted by the upper branch of a belt 17 wound in a loop about three deflection rollers 18,19,20, at least one of which is driven, and a tensioner roller 21.

The output of the pre-supply unit 15 is defined by two inclined and converging walls 22,23 which convey the tobacco leaving the unit 15 onto the band 16.

On the side opposite the wall 23 the chamber 14 is delimited by a carding roller 24 adjacent the downstream end of the band 16 and rotating in an anti-clockwise sense as viewed in FIG. 2. Beneath the roller 24 there is provided a cylindrical cowling 25 coaxial thereto, which supports at one end a connection plate 26 between the band 16 and the outer periphery of the roller 24. The roller 24 forms part of a main supply or carding unit 27 which further includes a roller 28, called a metering roll, rotating in an anti-clockwise sense in FIG. 2 and disposed in position overlying and substantially tangential to the roller 24. The roller 24 is provided with a plurality of substantially radial teeth which take up the tobacco supplied from the band 16 and transfer it out of the chamber 14 in the form of a continuous layer of tobacco the thickness of which is substantially equal to the radial dimensions of the said teeth and the density of which is inversely proportional to the velocity of the metering roller 28.

Figure 3:
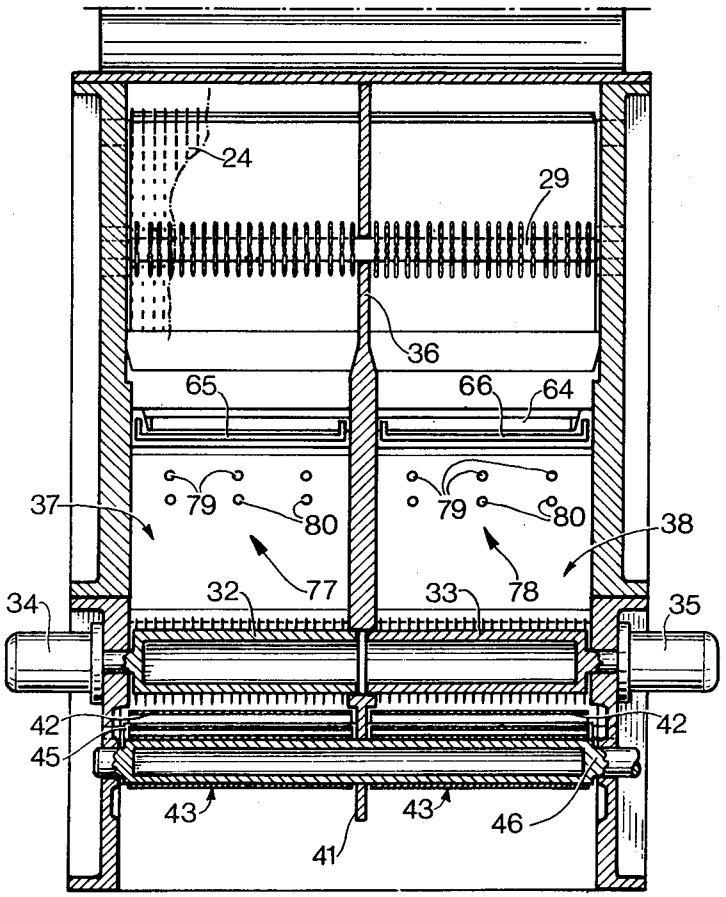
FIG. 3 is a section taken on the line III—III of FIG. 2.

A toothed roll 29, called a thrower roll, takes the said layer of tobacco from the roll 24 projecting it, in the form of separate particles, into an input hopper 30 of a substantially vertical duct 31 which is closed at the bottom by an advancement unit comprising two toothed advancement rollers 32,33 (FIG. 3) identical and coaxial with one another, rotatably mounted about an axis parallel to the axis of the roller 24 and driven by respective motors 34,35. In the region lying between the metering roll 28 and the advancement rollers 32,33 the distributor 2 is separated into two equal parts by a wall 36 disposed in an intermediate position with respect to the walls 8,9 and parallel to these. The wall 36 is traversed by the thrower roll 29 and has a lateral peripheral edge which follows the outer profile of the rolls 28,24.

The lower part of the wall 36 extends into the duct 31 subdividing it into two equal and parallel descending shafts 37, 38.

The rollers 32, 33 transfer out from the associated descending shafts 37, 38 two layers of tobacco each of which has a thickness substantially equal to the radial dimensions of the teeth of the rollers 32, 33 and is supplied to a toothed roller 39, called a thrower roller, within a chamber 40 in the form of a flow of separate tobacco particles.

The chamber 40 is subdivided by an inner wall 41, coplanar with the wall 36, into two equal parts each of which is closed at the bottom by a respective band 42 movable from right to left as viewed in FIG. 2 and inclined upwardly in the direction of movement. Each band 42 is constituted by the upper branch of a respective belt 43 looped over three deflector rollers 44, 45, 46 at least one of which is driven, and a tensioner roller 47.

The particles of tobacco thrown from the roller 39 form on the respective bands 42, two layers of tobacco of substantially uniform thickness which, once the downstream end of the associated band 42 has been reached, pass a roller 51 and are deflected upwardly in the form of separate particles by rising air currents generated by a source of compressed air, not illustrated, and supplied to respective ascending shafts 48, 49 through a duct 50.

At the upper end of the shafts 48, 49 (see also FIG. 1) the tobacco particles adhere to the lower surface of respective suction conveyor belts 52,53 on which respective layers or strands 54,55 form by accumulation, the density and/or the weight of which layers are detected by respective sensors 56,57. The layers 54,55, during their transfer by the action of the suction belts 52,53, are subjected, by respective shaving devices 58 (FIG. 1) to a trimming operation for the purpose of rendering the height or the thickness substantially constant.

Each shaving device 58 is normally constituted by a pair of counter rotating discs 59 (one of which is shown in FIG. 1) and provided with cutting edges. The said two discs 59 are located tangentially in contact with one another and shave the associated layers 54,55 allowing the tobacco cut away to fall into a collection duct 60 which is common to both the two layers 54,55.

As illustrated in FIGS. 2 and 6, an end portion of the duct 60 is formed by a channel 61 extending into the casing 4 below the band 16 in a direction parallel to the axis of the roller 24. The channel 61 includes two fixed side walls 62, and a movable bottom wall constituted by a conveyor belt 63, the downstream end of which is disposed above a hopper 64. The latter is positioned above the adjacent ends of two identical channels 65,66 which open out into the interior of the duct 31 below the hopper 30 and are positioned on opposite sides of the wall 36 in such a way as to communicate, respectively, with the shaft 37 and the shaft 38.

Each of the channels 65,66 is located in a position slightly inclined towards the duct 31 and is coupled to a vibrator device 67 operable to impart to the associated channels 65,66 a vibration the frequency of which is controlled by a comparator device 68 for comparing signals emitted by the sensors 56,57. The comparator device 68 is moreover operable to control the motors 34,35 for driving the rollers 32,33 in such a way as to vary the speed thereof in a manner such as to conform to the frequency variations imparted to the corresponding vibrator devices 67.

In use, signals proportional to the density and/or weight of the two layers 54,55 are sent to the comparator device 68 which modifies the frequency of the vibrator devices 67 and the speed of the motors 34,35 in such a way as to cancel any possible differences between the said two signals and between these latter and a reference signal emitted by an adjustable emitter 69 connected to the comparator device 68 and which in some cases can be omitted.

Figure 4:
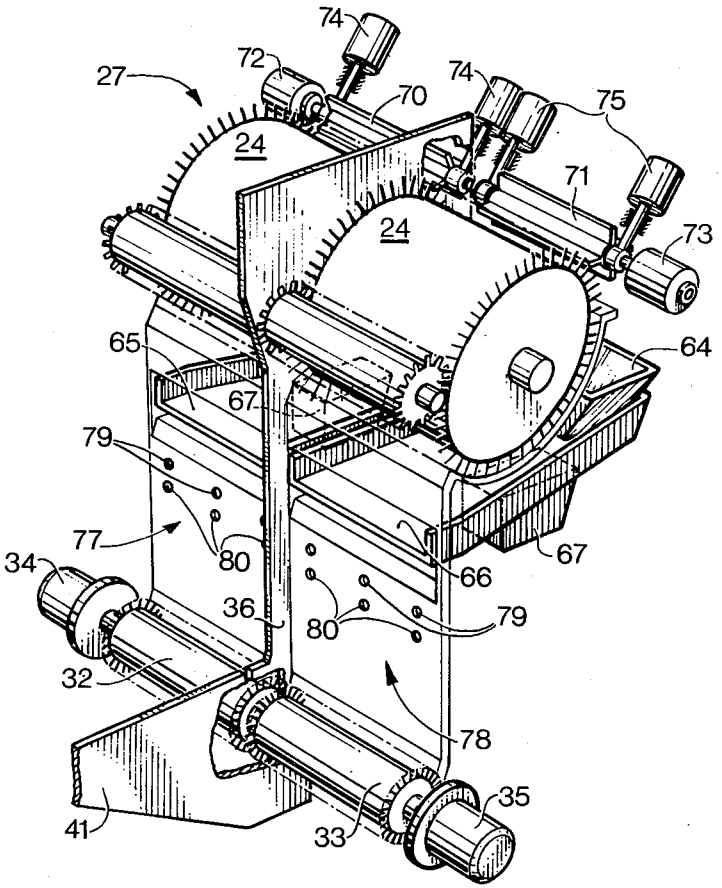
FIG. 4 is a schematic perspective view of a variant of the detail of FIG. 1.

In the variant as illustrated in FIG. 4, for the purpose of facilitating the control and adjustment of the density and weight of the layers 54,55 it is possible to act not only on the vibrator devices 67 and their motors 34,35, but directly upstream of the shafts 37,38 on the carding unit 27.

As explained above this is made possible by the fact that the metering roller 28 of FIG. 2 is substituted by two metering rollers 70,71 which are substantially coaxial with one another and which are positioned in alignment with the shafts 37,38 respectively and are operated by respective motors 72,73. In this way, by varying the speed of rotation of the two rollers 70,71 with respect to one another, it is possible to make the density of the two layers of tobacco advanced by the teeth of the carding roller 24 different from one another.

Figure 5:
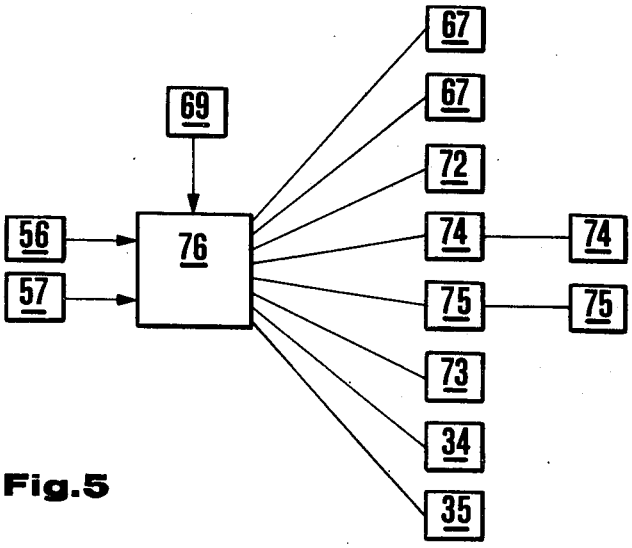
FIG. 5 is a block schematic diagram illustrating the control of the variant of FIG. 4.

Alternatively, or in combination with the above described characteristic, the variant of FIG. 4 has a further characteristic in the fact that the rollers 70, 71 are supported by respective pairs of actuators 74,75 operable to displace the respective rollers 70,71 towards and away from the roller 24 independently of one another. In this way it is possible to make the thicknesses of the two layers of tobacco advanced by the carding roller different from one another, the fact remaining that the thickness of the said two layers can be at most equal to the radial extent of the teeth of the roller 24. In the case of the variant of FIG. 4 it is convenient to substitute, as illustrated in FIG. 5, the comparator device 68 of FIG. 2 with a logic unit 76 which receives the signals emitted by the sensors 56,57 and the reference signal emitted by the device 69 and simultaneously control the motors 34,35 and the control means constituted by the vibrator device 67, the motors 72,73 and the pairs of actuators 74,75 according to pre-established programmes for the purpose of making the adjustment of the two layers 54,55 as fine as possible.

In another variant, not illustrated, the comparator 68 or the logic unit 76 directly controls only the motors 34,35 of the advancement rollers 32,33, whilst the vibrators 67 and possibly the motors 72,73 and the pairs of actuators 74,75 are dependent on detectors 77,78, for example of the optical type, respectively positioned along the descending shaft 37 and along the ascending shaft 38. Such detectors 77,78, each comprising two pluralities of photodiodes 79,80 defining a maximum level and a minimum level for the tobacco control the adjustment of the means they serve in such a way as to maintain the tobacco within the said descending shafts 37,38 at substantially constant and equal levels.

In a further variant, also not illustrated, the vibrators 67 as well as the motors 34,35 are controlled by the comparator 68 or the logic unit 76, whilst the function of maintaining the levels of tobacco within the descending shafts 37,38 constant and equal is entrusted to the rollers 70,71, which therefore are dependent on the detectors 77,78.

I claim:

1. A continuous twin rod cigarette-making machine for simultaneously manufacturing two continuous rods of cigarette, comprising a descending passage (31) for tobacco particles, an inner wall (36) arranged inside said descending passage (31) and defining therein two substantially equal descending shafts (37, 38), a carding unit (27) arranged upstream from said descending shafts (37, 38) in the direction of advancement of said particles, two ascending shafts (48, 49) for said particles arranged partially alongside one another and downstream from said descending shafts (37, 38), suction conveyor means (52, 53) for said particles arranged at the upper end of each of said ascending shafts (48, 49) for the formation of respective continuous layers (54, 55) of tobacco, an advancement unit including two advancement rollers (32, 33) each arranged beneath a lower end of a respective said descending shaft (37, 38), two drive means (34, 35) for said rollers (32, 33), said two drive means being independent from one another, detector means (56, 57) detecting the density and/or the weight of each of said layers (54, 55) and each controlling a respective said drive means (34, 35), and adjustment means for adjusting the quantity of tobacco supplied to each said descending shaft (37, 38).

2. A machine according to claim 1, wherein said adjustment means comprises feeding means (63) for re-cycled tobacco particles, two channels (65, 66) each interposed between a respective said descending shaft (37, 38) and said feeding means (63), and two vibrator devices (67) each coupled to a respective said channel (65, 66) and having adjustable frequency of vibration.

3. A machine according to claim 2, wherein said feeding means comprises a signal conveyor (63) and a hopper (64) disposed above input ends of both the said channels (65, 66) and downstream of the said conveyor (63), the conveyor communicating with a collection duct (60) for tobacco separated from the said layers (54, 55) by shaver means (58).

4. A machine according to claim 2, wherein said vibrator devices (67) are controlled by the said detector means (56, 57) disposed along the paths of the said layers (54, 55).

5. A machine according to claim 2, wherein level detecting means (77, 78) are provided which are sensitive to the level of the tobacco within the descending shafts (37, 38); said level detecting means (77, 78) controlling said vibrator device (67).

6. A machine according to claim 1, wherein said adjustment means include two metering rollers (70, 71) forming part of the said carding unit (27) and arranged alongside and substantially tangential to a single carding roller (24) on opposite sides of the said inner wall (36).

7. A machine according to claim 6, wherein said two metering rollers (70, 71) are provided with respective drive means (72, 73) which are independent from one another.

8. A machine according to claim 6, wherein said two metering rollers (70, 71) are provided with respective actuators (74, 75) directed radially with respect to the said carding roller (24) to displace the associated metering roller (70, 71) towards and away from the said carding roller (24).

9. A machine according to claim 6, wherein said two metering rollers (70, 71) are controlled by said detector means (56, 57) positioned along the paths of the said layers (54, 55).

10. A machine according to claim 6, wherein said two metering rollers (70, 71) are controlled by detector means (77, 78) sensitive to the level of tobacco within the said descending shafts (37, 38).

* * * * *